US006997675B2

(12) United States Patent
Dube et al.

(10) Patent No.: US 6,997,675 B2
(45) Date of Patent: Feb. 14, 2006

(54) TURBULATED HOLE CONFIGURATIONS FOR TURBINE BLADES

(75) Inventors: Bryan P. Dube, Columbia, CT (US); William Abdel-Messeh, Middletown, CT (US); Daniel Herrera, East Hartford, CT (US); Richard Page, Guilford, CT (US)

(73) Assignee: United Technologies Corporation, Hartford, CT (US)

( * ) Notice: Subject to any disclaimer, the term of this patent is extended or adjusted under 35 U.S.C. 154(b) by 63 days.

(21) Appl. No.: 10/774,989

(22) Filed: Feb. 9, 2004

(65) Prior Publication Data

US 2005/0175454 A1 Aug. 11, 2005

(51) Int. Cl.
*F01D 5/08* (2006.01)

(52) U.S. Cl. ..... 415/115; 416/96 R; 416/97 R

(58) Field of Classification Search ..... 415/115, 415/116; 416/65, 96 R, 97 R, 96 A, 95

See application file for complete search history.

(56) References Cited

U.S. PATENT DOCUMENTS

| | | | | |
|---|---|---|---|---|
| 5,232,343 A * | 8/1993 | Butts | ..... | 416/97 R |
| 5,413,463 A | 5/1995 | Chiu et al. | | |
| 6,234,752 B1 * | 5/2001 | Wei et al. | ..... | 416/96 R |
| 6,416,283 B1 * | 7/2002 | Johnson et al. | ..... | 416/97 R |
| 6,672,836 B1 * | 1/2004 | Merry | ..... | 416/97 R |

* cited by examiner

*Primary Examiner*—Edward K. Look
*Assistant Examiner*—Dwayne J White
(74) *Attorney, Agent, or Firm*—Backman & LaPointe, P.C.

(57) ABSTRACT

A turbine blade having improved cooling has an airfoil with a root end and a tip end and at least one cooling passageway in the airfoil. Each cooling passageway extends from the root end to the tip end and has a circular cross-section. A plurality of turbulation promotion devices are arranged in each cooling passageway. Each of the turbulation promotion devices is arcuate in shape and circumscribes an arc less than 180 degrees.

18 Claims, 4 Drawing Sheets

TURBULATED HOLE CONFIGURATIONS FOR TURBINE BLADES

BACKGROUND OF THE INVENTION

The present invention relates to gas turbine engines in general and in particular to turbine blades or buckets having cooling passages within the blade for efficient heat exchange with, and cooling of, the blade and more particularly to turbulated hole configurations for the cooling passages.

It is customary in turbine engines to provide internal cooling passages in turbine blades or buckets. It has also been recognized that the various stages of turbine rotors within the engines require more or less cooling, depending upon the specific location of the stage in the turbine. The first stage turbine buckets usually require the highest degree of cooling because those turbine blades, located after the first vane, are the blades exposed immediately to the hot gases of combustion flowing from the combustors. It is also known that the temperature profile across each turbine blade peaks along an intermediate portion of the blade and that the temperatures adjacent the root and tip portions of the blades are somewhat lower than the temperatures along the intermediate portion.

In some cases, a plurality of cooling passages are provided within the turbine blades extending from the blade root portion to the tip portion. Cooling air from one of the stages of the compressor is conventionally supplied to these passages to cool the blades. Turbulence promoters have been employed throughout the entire length of these passages to enhance the heat transfer of the cooling air through the passages. Thermal energy conducts from the external pressure and suction surfaces of turbine blades to the inner zones, and heat is extracted by internal cooling. Heat transfer performance in a channel having spaced apart ribs primarily depends on the channel diameter, the rib configuration, and the flow Reynolds number. There have been many fundamental studies to understand the heat transfer enhancement phenomena by the flow separation caused by the ribs. A boundary layer separates upstream and downstream of the ribs. These flow separations reattach the boundary layer to the heat transfer surface, thus increasing the heat transfer coefficient. The separated boundary layer enhances turbulent mixing, and therefore the heat from the near-surface fluid can more effectively get dissipated to the main flow, thus increasing the heat transfer coefficient.

The turbulence promoters used in these passageways take many forms. For example, they may be chevrons attached to side walls of the passageway, which chevrons are at an angle to the flow of cooling air through the passageway.

U.S. Pat. No. 5,413,463 to Chiu et al. illustrates turbulated cooling passages in a gas turbine bucket where turbulence promoters are provided at preferential areas along the length of the airfoil from the root to the tip portions, depending upon the local cooling requirements along the blade. The turbulence promoters are preferentially located in the intermediate region of the turbine blade, while the passages through the root and tip portions of the blade remain essentially smoothbore.

Despite the existence of these turbine blades having turbulated cooling passageways, there remains a need for blades which exhibit improved cooling.

SUMMARY OF THE INVENTION

Accordingly, it is an object of the present invention to provide turbine blades having cooling passageways with turbulation promotion devices which promote cooling.

The foregoing object is attained by the turbine blades of the present invention.

In accordance with the present invention, a turbine blade having improved cooling is provided. The turbine blade has an airfoil with a root end and a tip end and at least one cooling passageway in the airfoil. Each cooling passageway extends from the root end to the tip end and has a circular cross-section. A plurality of turbulation promotion devices are arranged in each cooling passageway. Each of the turbulation promotion devices is arcuate in shape and circumscribes an arc less than 180 degrees.

Other details of the turbulated hole configurations for a turbine blade of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
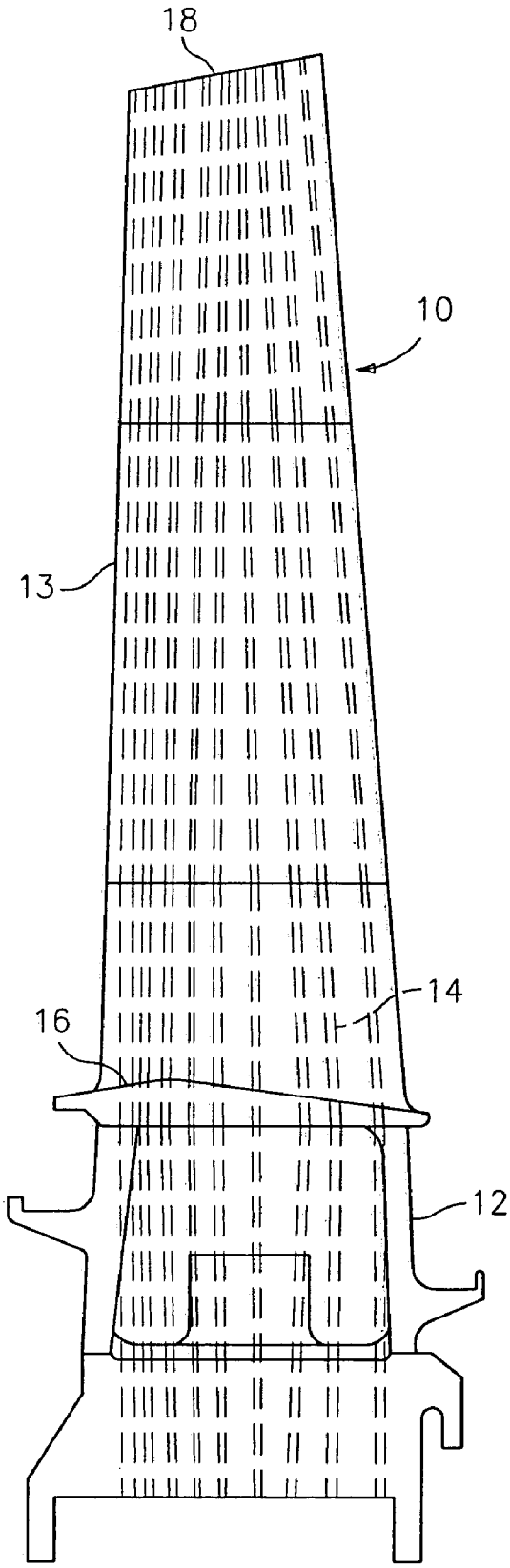
FIG. 1 illustrates a turbine blade used in a gas turbine engine having a plurality of internal cooling passageways.

Referring now to FIG. 1, there is illustrated a gas turbine blade 10 mounted on a pedestal 12 and having an airfoil 13 with a plurality of internal cooling passageways 14 extending through the blade 10 over its entire length, including from a root end 16 of the airfoil 13 to a tip end 18 of the airfoil 13. Typically, the turbine blade 10 has a plurality of cooling passageways 14. Each of the cooling passageways 14 exits at the tip end 18. Further, each of the cooling passageways 14 conducts a cooling fluid, e.g. air, from an inlet in communication with a source of air, such as compressor bleed air, throughout its entire length for purposes of cooling the material, e.g. metal, of the turbine blade 10. The turbine blade 10 may be formed from any suitable metal known in the art such as a nickel based superalloy. As will be discussed hereinafter, to improve the cooling characteristics of the turbine blade 10, each of the cooling passageways 14 has a plurality of turbulation promotion devices.

Figure 2:
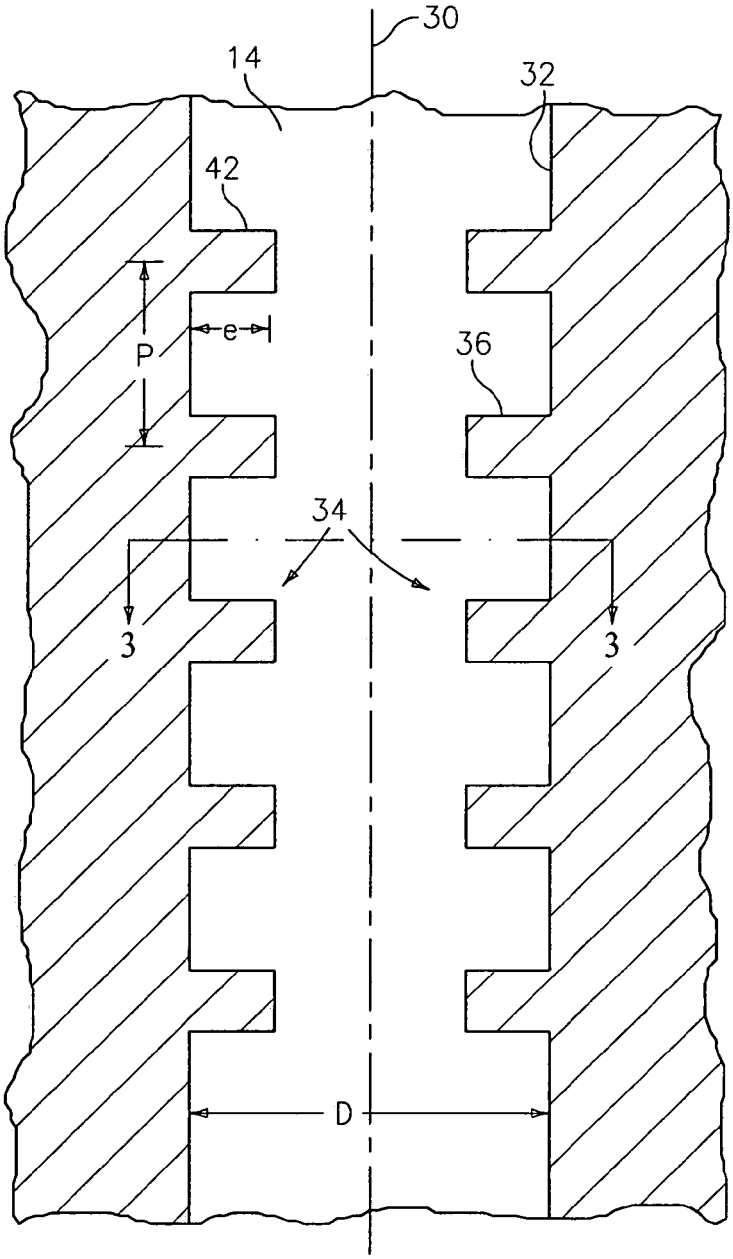
FIG. 2 is a sectional view of a turbulated cooling passageway in accordance with the present invention.
Figure 3:
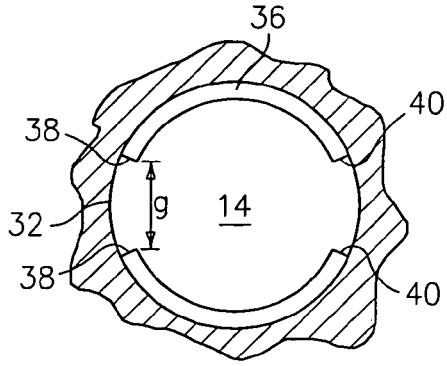
FIG. 3 is a sectional view taken along lines 3—3 in FIG. 2.

Referring now to FIGS. 2 and 3, there is shown a first embodiment of a cooling passageway 14 which has a circular cross-section. The cooling passageway 14 extends along an axis 30 from the root end 16 to the tip end 18 and has a wall 32. The wall 32 defines a passageway for the cooling fluid having a diameter D.

A plurality of turbulation promotion devices 34 is incorporated into the passageway 14. The turbulation promotion devices may comprise arcuately shaped trip strips 36 which have a height e and which circumscribe an arc of less than 180 degrees. The ratio of e/D is preferably in the range of from 0.05 to 0.30. In the arrangement shown in FIGS. 2 and 3, the turbulation promotion devices 34 comprises pairs of trip strips 36 formed on the wall 32. The trip strips 36 have end portions 38 and 40 which are spaced apart by a gap g. The gap g may be in the range of 1e to 4e. In a preferred embodiment, the gap g may be in the range of from 0.015 inches to 0.050 inches. The trip strips 36 also have a surface 42 which is normal to the axis 30 as well as to the flow of the cooling fluid through the passageway 14. The gaps g are preferably oriented away from the maximum heat load.

Also, as can be seen from FIG. 2, a plurality of pairs of trip strips 36 are positioned along the axis 30. The pairs of trip strips 36 are separated by a pitch P, which is the distance from the mid-point of a first trip strip 36 to a mid-point of a second trip strip 36. In a preferred embodiment of the present invention, the ratio of P/e is in the range of from 5 to 30.

The pairs of trip strips 36 are preferably aligned so that the gaps g of one pair of trip strips 36 is aligned with the gaps g of adjacent pairs of trip strips 36. It has been found that such an arrangement is very desirable from the standpoint of creating turbulence in the flow in the passageway 14 and minimizing the pressure drop of the flow.

Figure 4:
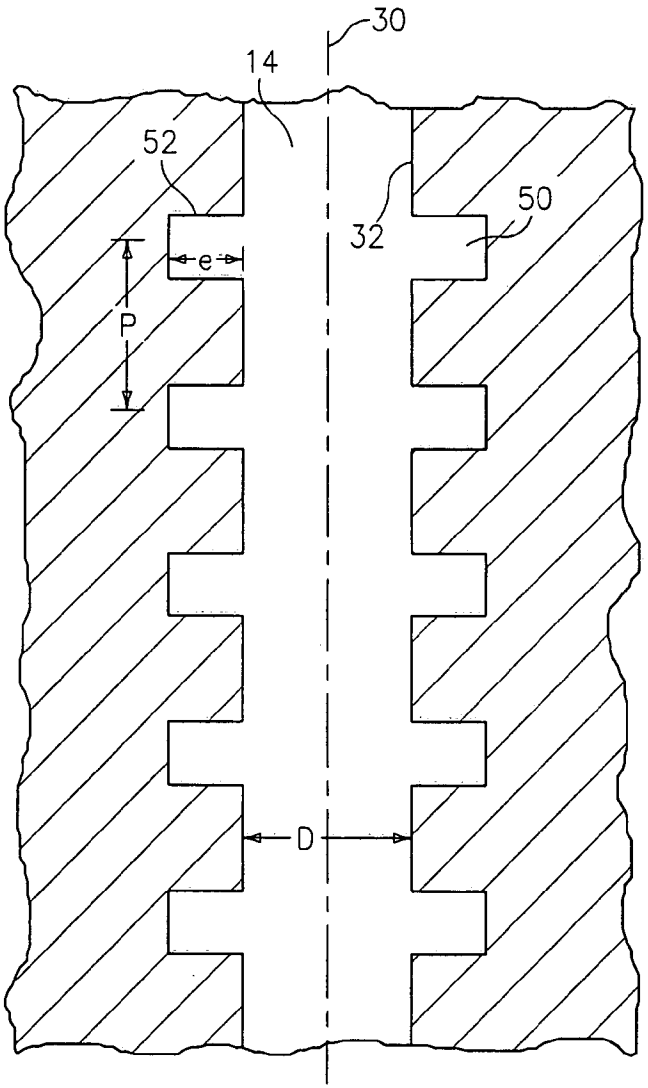
FIG. 4 is a sectional view of an alternative embodiment of a turbulated cooling passageway in accordance with the present invention.

Referring now to FIG. 4, instead of trip strips formed on the wall 32, the turbulation promotion devices 34 may be notches 50 cut into the wall 32. As before, each of the notches 50 may be arcuate in shape and may circumscribe an arc of less than 180 degrees. Still further, the notches may have a ratio of e/D which is in the range of from 0.05 to 0.30 and may have a surface 52 which is normal to the axis 30 and the flow of the cooling fluid through the passageway 14. As before, the ratio of P/e is in the range of from 5 to 30.

Figure 5:
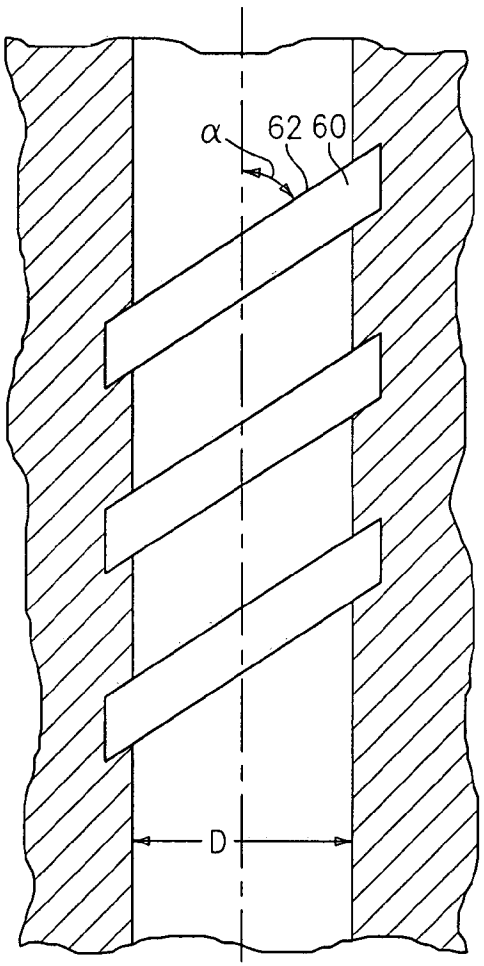
FIG. 5 is a sectional view of another alternative embodiment of a turbulated cooling passageway in accordance with the present invention.

Referring now to FIG. 5, there is shown an alternative embodiment of a cooling passageway 14 having turbulation promotion devices 60 which have a surface 62 which is at an angle $\alpha$ in the range of 30 degrees to 70 degrees, such as 45 degrees, with respect to the axis 30 and the flow of the cooling fluid through the passageway 14. The turbulation promotion devices may be either trip strips on the wall 32 or notches in the wall 32. As before, the turbulation promotion devices 60 are preferably arcuate in shape and circumscribe an arc less than 180 degrees. The turbulation promotion devices 60 may be aligned pairs of devices 60 which have end portions spaced apart by a gap. The turbulation promotion devices of each pair may be offset along the axis 30. This has the benefit of a reduced pressure drop for an equivalent heat transfer level. Here again, the ratio P/e may be in the range of from 5 to 30.

Figure 6:
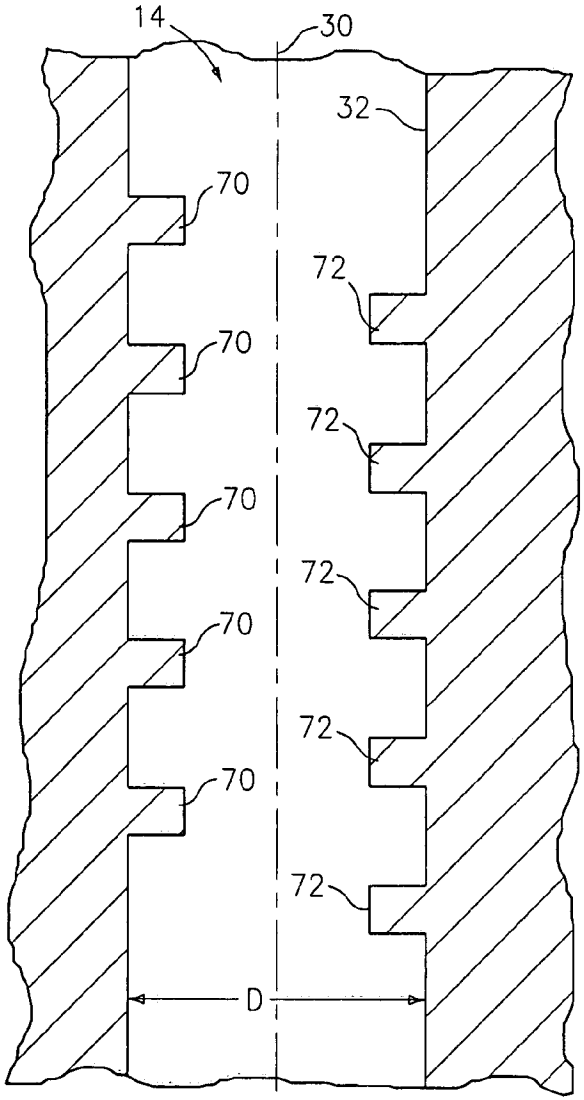
FIG. 6 is a sectional view of an alternative embodiment of a turbulated cooling passageway in accordance with the present invention having offset turbulation promotion devices.

Referring now to FIG. 6, another embodiment of a cooling passageway 14 is illustrated. In this embodiment, the turbulation promotion devices include a first set of trip strips 70 and a second set of trip strips 72. The first set of trip strips 70 are preferably offset from the second set of trip strips 72. The trip strips 70 and 72 are both arcuate in shape and circumscribe an arc of less than 180 degrees. As before the trip strips 70 and 72 have a ratio of e/D in the range of from 0.05 to 0.30. The ratio P/e for each of the sets is preferably in the range of from 5 to 30.

Figure 7:
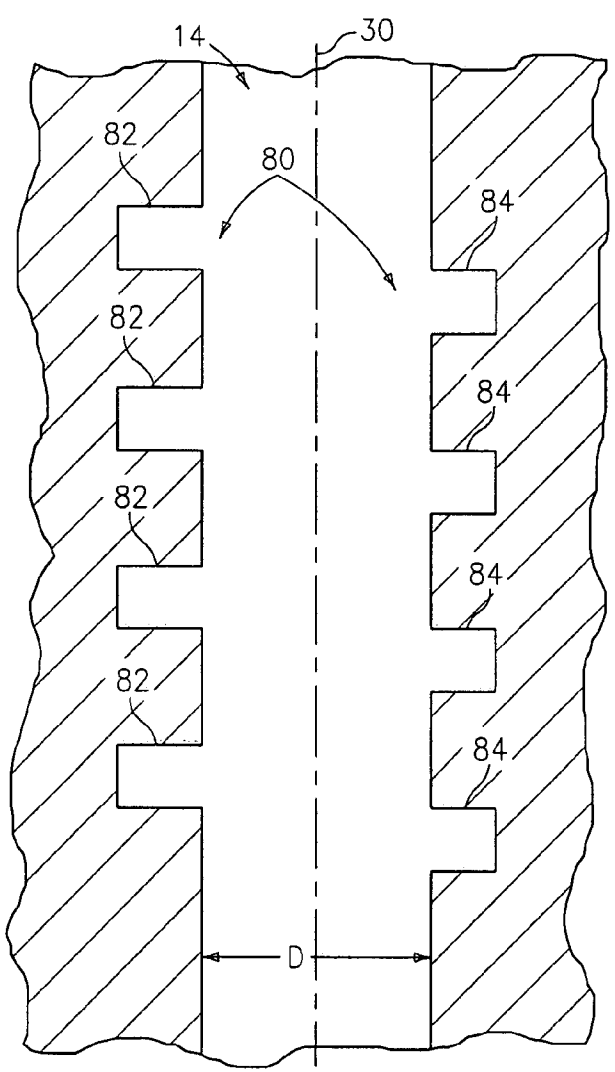
FIG. 7 is a sectional view of still another alternative embodiment of a turbulated cooling passageway having offset turbulation promotion devices.

Referring now to FIG. 7, there is shown still another embodiment of a cooling passageway 14 having offset turbulation promotion devices 80. The offset turbulation devices 80 take the form of a first set of notches 82 and a second set of offset notches 84. Each of the notches 82 and 84 is arcuate in shape and circumscribes an arc less than 180 degrees. Each of the notches 82 and 84 may have a ratio of e/D in the range of from 0.05 to 0.30. In this embodiment, as in the others, the ratio P/e for each set of notches is in the range of 5 to 30.

The cooling passages shown in FIGS. 2–7 may be formed using any suitable technique known in the art. In a preferred embodiment of the present invention, the cooling passageways 14 with the various turbulation promotion devices are formed using a STEM drilling technique.

The cooling passages 14 have the turbulation hole configurations of FIGS. 2–7 exhibit improved cooling at a reduced pressure drop from the inlet of the passageway to the outlet of the passageway.

Referring to FIG. 3, while only two trip strips 36 have been shown in this figure, it should be recognized that the passageway 14 could have more than two aligned trip strips each separated from an adjacent trip strip 36 by a gap g. For example, the passageway 14 could have four or eight aligned trip strips 36. In a situation where there are four aligned trip strips 36, each of the trip strips could circumscribe an arc which is less than 90 degrees. In a situation where there are eight aligned trip strips, each of the trip strips could circumscribe an arc which less than 45 degrees.

It is apparent that there has been provided in accordance with the present invention turbulated hole configurations for turbine blades which fully satisfy the objects, means, and advantages set forth hereinbefore. While the present invention has been described in the context of specific embodiments thereof, other alternatives, modifications, and variations will become apparent to those skilled in the art having read the foregoing detailed description. Accordingly, it is intended to embrace those alternatives, modifications, and variations as fall within the broad scope of the appended claims.

What is claimed is:

1. A turbine blade comprising:

an airfoil having a root end and a tip end;

at least one cooling passageway in said airfoil, said at least one cooling passageway extending from the root end to the tip end and having a circular cross-section;

a plurality of turbulation promotion devices in said at least one cooling passageway;

said plurality of turbulation promotion devices comprising a plurality of pairs of aligned turbulation promotion devices; and each of said plurality of turbulation promotion devices in each said pair being arcuate in shape and circumscribing an arc less than 180 degrees.

2. A turbine blade according to claim 1, wherein each said pair of aligned turbulation promotion devices have end portions of a first one of said pair of aligned turbulation promotion devices being spaced apart from end portions of a second one of said pair of aligned turbulation promotion devices.

3. A turbine blade according to claim 2, wherein said end portions are spaced by a gap in the range of from 1e to 4e where e is the height of a turbulation promotion device.

4. A turbine blade according to claim 2, wherein each said passageway has a diameter D and each turbulation promotion device has a height e, and wherein the ratio of e/D is in the range of from 0.05 to 0.30.

5. A turbine blade according to claim 1, wherein said turbulation promotion device comprise arcuately shaped trip strips.

6. A turbine blade according to claim 1, wherein said plurality of turbulation promotion devices comprises a plurality of turbulation promotion devices aligned along an axis which extends from said root end to said tip end.

7. A turbine blade according to claim 6, wherein said plurality of turbulation promotion devices are separated by a pitch P, each of said turbulation promotion devices has a height e, and a ratio of P/e is in the range of 5 to 30.

8. A turbine blade according to claim 6, wherein said aligned turbulation promotion devices comprise pairs of aligned turbulators with each pair of turbulators having spaced apart end portions.

9. A turbine blade according to claim 8, wherein said spaced apart end portions of a first pair of turbulators is axially aligned with spaced apart end portions of adjacent pairs of turbulators.

10. A turbine blade according to claim 1, wherein said turbulation promotion devices comprises a plurality of notches cut into a wall of said at least one cooling passageway.

11. A turbine blade according to claim 1, wherein said turbulation promotion devices comprise a first set of turbulators and a second set of turbulators offset from said first set of turbulators.

12. A turbine blade according to claim 1, wherein each of said turbulation promotion devices has a surface which is normal to an axis extending from said tip end to said root end.

13. A turbine blade according to claim 1, wherein each of said turbulation promotion devices has a surface which is at an angle in the range of from 30 degrees to 70 degrees with respect to an axis extending from said tip end to said root end.

14. A turbine blade according to claim 12, wherein said turbulation promotion devices comprise a first set of turbulators and a second set of turbulators offset from said first set of turbulators.

15. A turbine blade according to claim 1, further comprising a plurality of cooling passageways extending from said root end to said tip end and each of said cooling passageways having a plurality of said turbulation promotion devices.

16. A turbine blade according to claim 15, wherein said plurality of turbulation promotion devices in each of said cooling passageways has a surface which is normal to a flow of cooling fluid through said cooling passageways.

17. A turbine blade according to claim 15, wherein said plurality of turbulation promotion devices in each of said cooling passageways has a surface which is at an angle in the range of from 30 degrees to 70 degrees with respect to a flow of cooling fluid through said cooling passageways.

18. A turbine blade according to claim 15, wherein said plurality of turbulation promotion devices in each of said cooling passageways includes a first set of turbulation promotion devices which is offset from a second set of turbulation promotion devices.

* * * * *